US011639063B2

(12) United States Patent
Ruan et al.

(10) Patent No.: US 11,639,063 B2
(45) Date of Patent: May 2, 2023

(54) PRINTING MECHANISM FOR SAMPLE CONTAINER

(71) Applicants: NINGBO FIRST HOSPITAL, Ningbo (CN); ZHEJIANG GONGDONG MEDICAL TECHNOLOGY CO., LTD., Taizhou (CN)

(72) Inventors: Liemin Ruan, Ningbo (CN); Qinhong Xu, Ningbo (CN); Shoujun Luo, Ningbo (CN)

(73) Assignees: NINGBO FIRST HOSPITAL, Ningbo (CN); ZHEJIANG GONGDONG MEDICAL TECHNOLOGY CO., LTD., Taizhou (CN)

( * ) Notice: Subject to any disclaimer, the term of this patent is extended or adjusted under 35 U.S.C. 154(b) by 0 days.

(21) Appl. No.: 17/648,019

(22) Filed: Jan. 14, 2022

(65) Prior Publication Data

US 2022/0234367 A1 Jul. 28, 2022

(30) Foreign Application Priority Data

Jan. 26, 2021 (CN) ..... 202110101558.9

(51) Int. Cl.
*B41J 3/407* (2006.01)

(52) U.S. Cl.
CPC ..... *B41J 3/40731* (2020.08)

(58) Field of Classification Search
CPC ..... B41J 3/407; B41J 3/40731; B41J 3/40733
See application file for complete search history.

(56) References Cited

U.S. PATENT DOCUMENTS 6,135,654 A * 10/2000 Jennel ..... B41M 7/0081 400/70
2018/0281456 A1* 10/2018 McConville ..... B41F 17/006

FOREIGN PATENT DOCUMENTS

CN 108053552 A * 5/2018 ..... B41J 2/471
CN 108053552 A 5/2018
CN 207291028 U 5/2018

OTHER PUBLICATIONS

Luos, MachineTranslationofCN-108053552-A, 2018 (Year: 2018).*

* cited by examiner

*Primary Examiner* — Scott A Richmond
(74) *Attorney, Agent, or Firm* — Innovation Capital Law Group, LLP; Vic Lin

(57) ABSTRACT

A printing mechanism for a sample container is provided with a receiving end provided with a receiving rack, the receiving rack being connected with a fixed receiving plate and a movable receiving plate, wherein corresponding receiving trough and falling channel are formed by splicing and separating the fixed receiving plate and the movable receiving plate; and a discharging end provided with a rotating assembly that receives a sample container falling in the falling channel and drives the sample container to rotate to align an unprinted blank region on the sample container with a printing assembly.

12 Claims, 5 Drawing Sheets

PRINTING MECHANISM FOR SAMPLE CONTAINER

BACKGROUND OF THE INVENTION

1. Technical Field

The present invention belongs to the technical field of medical instruments, and relates to a printing mechanism, in particular to a printing mechanism for a sample container.

2. Description of Related Art

At present, a body fluid inspection flow in hospital outpatient clinics is as follows: a patient goes to an inspection window with an inspection list, a worker selects a container according to doctor's advice and explain preserving requirements, the patient comes to the window again after taking a sample, and the worker receives the sample, prints a bar code and pastes the bar code to the container, and meanwhile, the worker prints a receipt to the patient and inform a list taking time and location. There are following problems: 1, it is necessary for the patient to queue up long in a peak period and the waiting time is long; 2, various mistakes such as insufficient sample collection amount, wrong taking of the container and the like are caused by various reasons; 3, the workload is large, so that a mistake of confusing one thing with another is prone to happen; 4, when the sample is received, it is necessary to print the bar code with a patient ID card and paste the bar code to the container and the receipt is printed for the patient. As the sample may have biohazard to lead to probability of hospital-acquired infection, patients often complain; and 5, the detection speed is reduced as the bar codes pasted manually are inconsistent, and it cannot exert the maximum efficiency.

BRIEF SUMMARY OF THE INVENTION

Aiming at the above-mentioned problem, the objective of the present invention is to provide a printing system capable of improving the work efficiency, reducing mistakes, avoiding the probability of hospital-acquired infection, shortening the inspection time, optimizing the treatment flow and improving the medical experience of the patient.

The objective of the present invention can be realized by the technical schemes as follows: a printing mechanism for a sample container, including:

a receiving end provided with a receiving rack, the receiving rack being connected with a fixed receiving plate and a movable receiving plate, wherein corresponding receiving trough and falling channel are formed by splicing and separating the fixed receiving plate and the movable receiving plate;

a discharging end provided with a rotating assembly that receives a sample container falling in the falling channel and drives the sample container to rotate to align an unprinted blank region on the sample container with a printing assembly;

wherein a position away from the receiving end is provided with a translation motor, an output end of the translation motor is connected with a lead screw, the receiving rack is spirally connected to the lead screw, a stopping arm is arranged on a moving trajectory of the receiving rack, and the fixed receiving plate and the movable receiving plate are separated and actuated as the stopping arm and an ejector rod lean against each other or are separated from each other.

In the printing mechanism for a sample container, the fixed receiving plate and the movable receiving plate are matched magnetically.

In the printing mechanism for a sample container, the fixed receiving plate is connected with a magnetic block and the movable receiving plate is connected with the ejector rod, wherein the ejector rod penetrates through the fixed receiving plate and the magnetic block and is spirally connected to the movable receiving plate, and the fixed receiving plate and the movable receiving plate are separated by pushing the ejector rod.

In the printing mechanism for a sample container, the rotating assembly includes a rotating bracket and the rotating bracket is connected with a rotating motor, wherein an output end of the rotating motor is connected with a primary rotating shaft and two auxiliary rotating shafts fitting the primary rotating shaft and being connected to the rotating bracket, and a "tripod"-shaped structure is formed between the primary rotating shaft and the two auxiliary rotating shafts.

In the printing mechanism for a sample container, each of two sides of the rotating bracket is provided with a first guide slot, and two ends of one of the auxiliary rotating shafts are respectively clamped into the first guide slots.

In the printing mechanism for a sample container, the rotating bracket is connected with a discharging guide plate.

In the printing mechanism for a sample container, the primary rotating shaft is embedded with an annular magnetic ring, or the auxiliary rotating shafts are embedded with annular magnetic rings, or both the primary rotating shaft and the auxiliary rotating shafts are embedded with annular magnetic rings.

In the printing mechanism for a sample container, the receiving rack is connected with a pushing structure and the pushing structure is located between the receiving trough and the stopping arm, wherein two auxiliary rotating shafts are separated at a relative distance via the pushing structure.

In the printing mechanism for a sample container, the pushing structure includes a pushing bracket and the pushing bracket is connected with ejector blocks in leaning fit with two ends of one of the auxiliary rotating shafts correspondingly, wherein each of the ejector blocks is provided with a first working inclined plane that pushes the auxiliary rotating shaft away and a second working inclined plane that restores the auxiliary rotating shaft, the first working inclined plane and the second working inclined plane being adjacent two inclined planes on the ejector blocks.

In the printing mechanism for a sample container, the first working inclined plane extends obliquely upwards from the end away from the receiving trough to the end close to the receiving trough and the second working inclined plane extends obliquely upwards from the end close to the receiving trough to the end away from the receiving trough, wherein a slope gradient of the first working inclined plane is smaller than that of the second working inclined plane.

In the printing mechanism for a sample container, two ends of the ejector block are respectively connected to the pushing bracket via rotating bars, wherein a connecting rod on the ejector block away from one end of the receiving trough is connected with an elastic piece, and the elastic piece is vertically connected to the pushing bracket via a fixing bar.

In the printing mechanism for a sample container, a side on the fixed receiving plate opposite to the movable receiving plate is provided with a guiding inclined plane, or a side on the movable receiving plate opposite to the fixed receiving plate is provided with a guiding inclined plane, or opposites of the fixed receiving plate and the movable receiving plate are both provided with guiding inclined planes.

Compared with the prior art, the present invention has the following beneficial effects:

(1) According to the printing mechanism for a sample container provided by the present invention, the sample container in the receiving trough falls onto the rotating structure below accurately by leaning and matching the stopping arm and the ejector rod, and the rotating motor is matched with the rotating structure, so that the sample container rotates. It is ensured that the blank region on the sample container corresponds to the printing assembly, so that patient information is printed, the transfer number of times of the sample container between inspection staff and the patient is reduced, a phenomenon of wrong taking or cross contamination is avoided, and therefore, the subsequent detection precision and detection efficiency is improved.

(2) The fixed receiving plate and the movable receiving plate are matched magnetically, so that it is convenient to change the relative distance between the fixed receiving plate and the movable receiving plate, and therefore, the sample containers in the receiving trough can fall onto the rotating structure below reliably. In addition, the ejector rod and the fixed receiving plate are in clamping fit via a protruding portion on the ejector rod, so that the relative distance between the fixed receiving plate and the movable receiving plate is controlled, and therefore, the ejector rod is prevented from sliding out of the fixed receiving plate, thereby, the using reliability of the receiving rack is improved.

(3) By means of screw fit, the ejector rod is rotated to adjust the distance when the movable receiving plate is far away from the fixed receiving plate, so that it is suitable for discharging sample containers of different sizes, and therefore, it is guaranteed that when the movable receiving plate is far away from the fixed receiving plate, the sample containers in the receiving trough can fall onto the rotating structure below reliably.

(4) As the primary rotating shaft or the auxiliary rotating shafts are embedded with the annular magnetic rings, an idle stroke is avoided when the primary rotating shaft drives the auxiliary rotating shafts to rotate, so that the rotating reliability of the sample containers is improved.

(5) By means of the pushing structure, the printed sample containers located on the rotating structure are discharged, and the unprinted sample containers on the receiving trough fall onto the rotating structure by leaning the receiving trough against the stopping arm to fit so as to form a continuous action, so that the printing working efficiency of the sample containers is improved.

(6) The rotating bracket is provided with the first guide slot, so that when the ejector block pushes the auxiliary rotating shaft, two ends of the auxiliary rotating shaft to move along the first guide slot. The moving linearity of the auxiliary rotating shaft is guaranteed, so that the printed sample containers are discharged smoothly.

Figure 1:
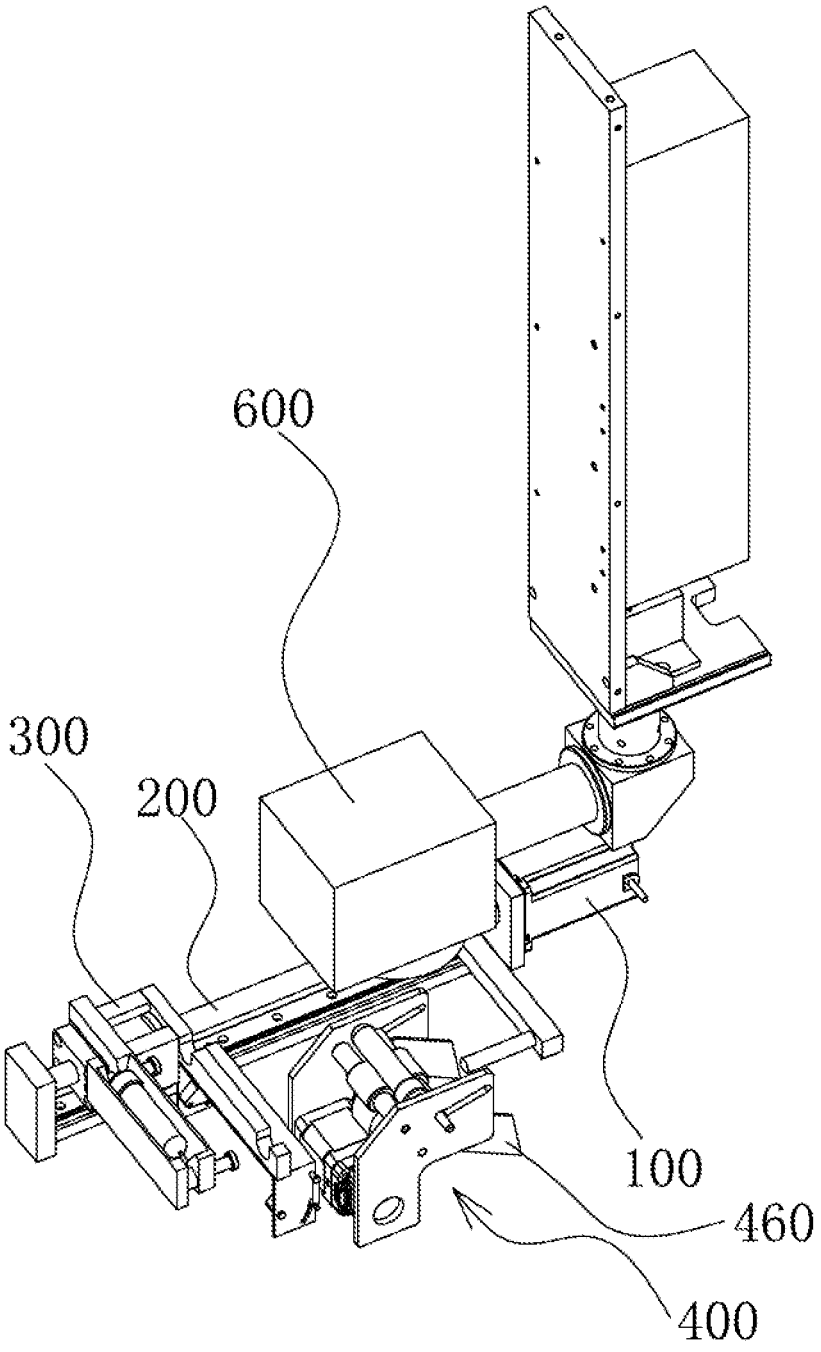
FIG. 1 is a structural schematic diagram of a printing mechanism for a sample container of the present invention.

In the drawings, 100, transition motor; 200, lead screw; 300, receiving rack; 310, receiving trough; 311, guiding inclined plane; 320, movable receiving plate; 330, ejector rod; 331, protruding portion; 340, movable receiving plate; 350, magnetic block; 400, rotating assembly; 410, rotating motor; 420, rotating bracket; 421, first guide slot; 430, primary rotating shaft; 440, auxiliary rotating shaft; 441, extension rod; 450, magnetic ring; 460, discharging guide plate; 500, stopping arm; 510, stopping rod; 600, printing assembly; 700, pushing structure; 710, pushing bracket; 711, second guide slot; 720, ejector block; 721, first working inclined plane; 722, second working inclined plane; 730, rotating bar; 740, elastic piece; 750, fixing bar.

DETAILED DESCRIPTION OF THE INVENTION

Specific embodiments of the present invention are described below, and further description on the technical scheme of the present invention is made below in combination with the drawings. The present invention is not limited to the embodiments.

Figure 2:
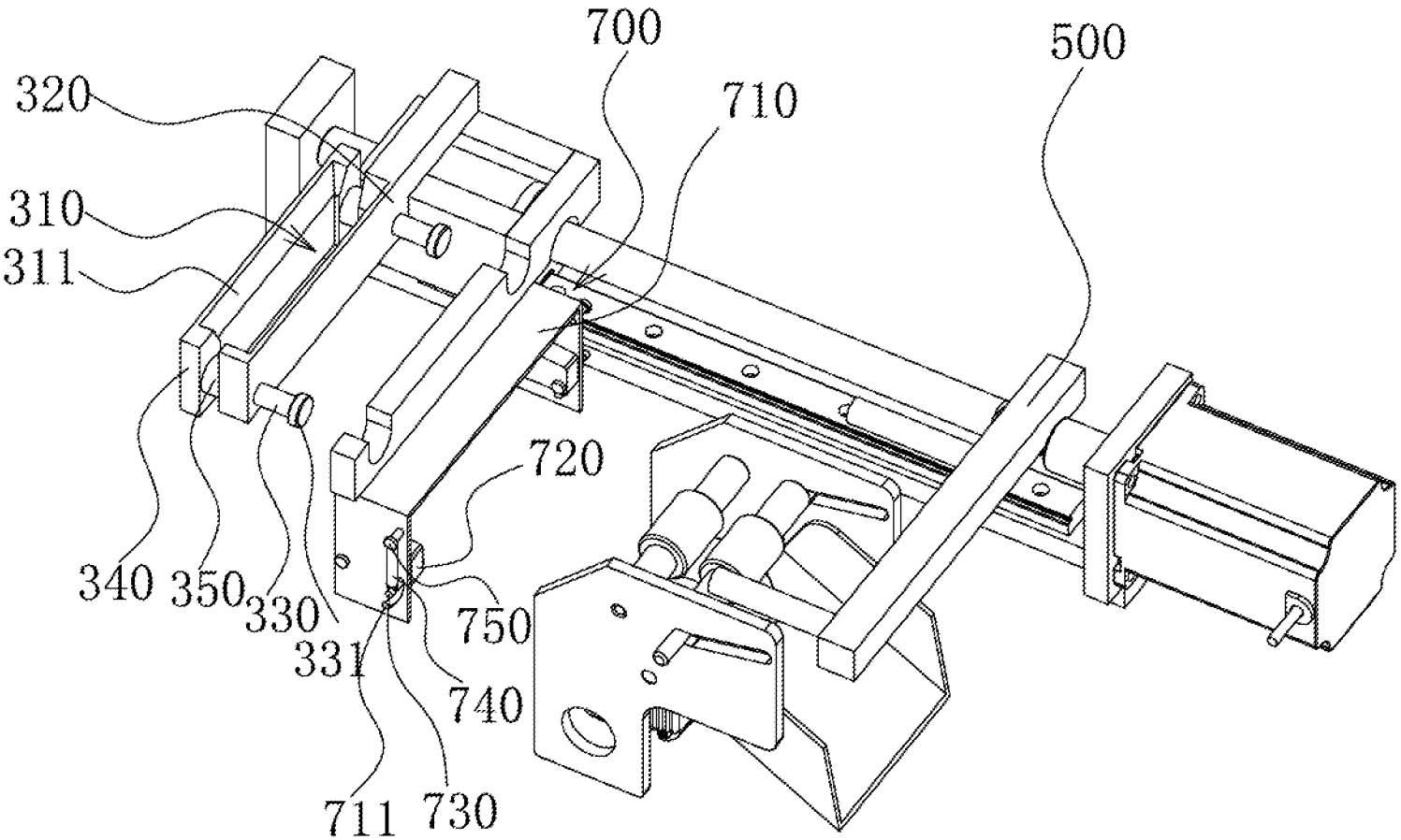
FIG. 2 is a local structural schematic diagram of a printing mechanism for a sample container of the present invention.
Figure 3:
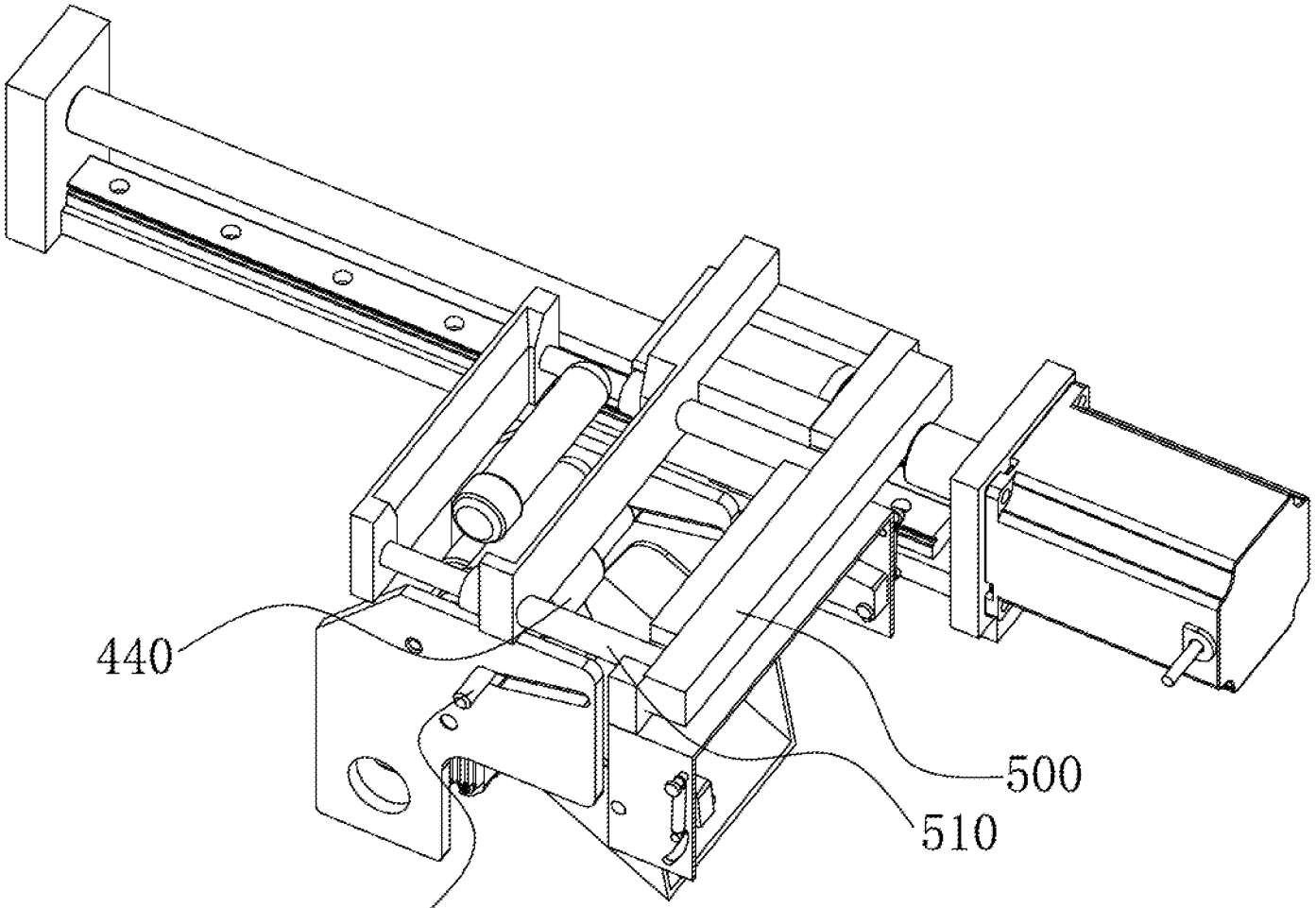
FIG. 3 is a structural schematic diagram of a sample container in a receiving rack falling to a rotating assembly in a preferred embodiment of the present invention.
Figure 4:
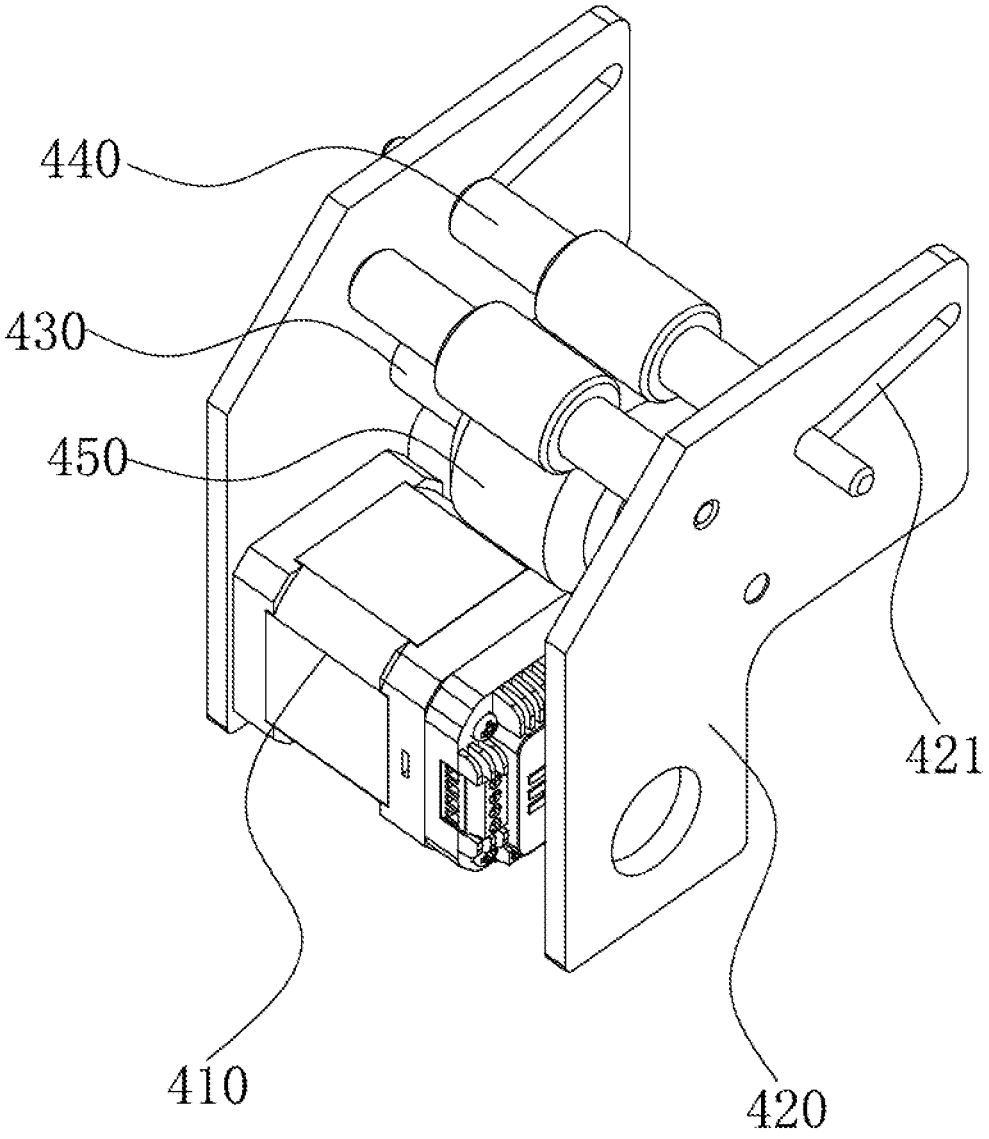
FIG. 4 is a structural schematic diagram of a rotating assembly in a preferred embodiment of the present invention.
Figure 5:
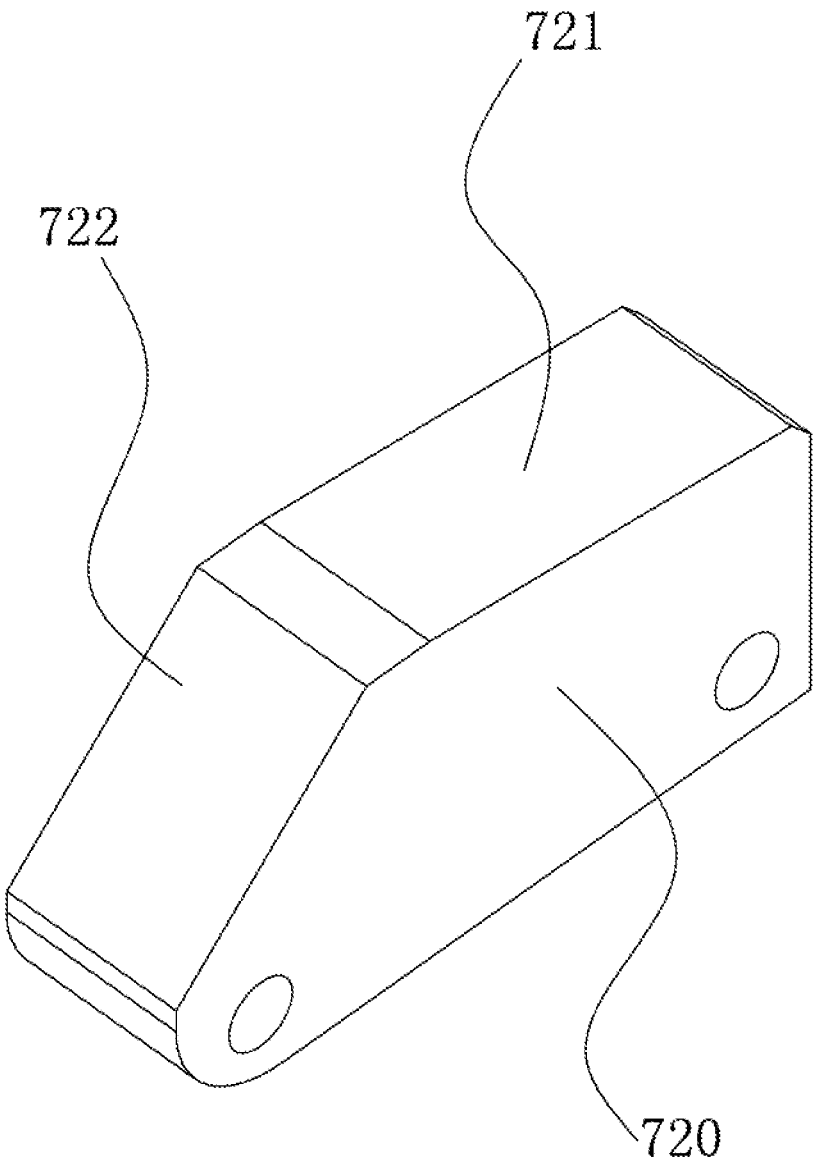
FIG. 5 is a structural schematic diagram of an ejector block in a preferred embodiment of the present invention.

As shown in FIG. 1 to FIG. 5, a printing mechanism for a sample container provided by the present invention includes:

a translation motor 100 located at a discharging end, an output end thereof is connected with a lead screw 200, and the lead screw 200 is spirally connected with a receiving rack 300, wherein the receiving rack 300 is located at a receiving end and is provided with a receiving trough 310. Two sides of the receiving trough 310 are respectively provided with fixed receiving plates 320 and a movable receiving plate 340 movably connected with the fixed receiving plates 320 via ejector rods 330;

a rotating assembly 400 located below the moving trajectory of the receiving rack 300, the rotating assembly 400 including the rotating motor 410, wherein the output end of the rotating motor 410 is connected with a rotating structure for receiving a sample container in the receiving trough 310 and rotating the sample container so as to correspond a blank region on the surface of the sample container to a printing assembly 600; and a stopping arm 500 located on the moving trajectory of the receiving rack 300, wherein the stopping arm 500 and the ejector rod 330 lean against each other to fit so as to push the movable receiving plate 340 to move along a side away from the fixed receiving plate 320, so that the sample container in the receiving trough 310 falls onto the rotating structure.

According to the printing mechanism for a sample container provided by the present invention, the sample container in the receiving trough 310 falls onto the rotating structure below accurately by leaning and matching the stopping arm 500 and the ejector rod 330, and the rotating motor 410 is matched with the rotating structure, so that the sample container rotates. It is ensured that the blank region on the sample container corresponds to the printing assembly 600, so that patient information is printed, the transfer number of times of the sample container between inspection staff and the patient is reduced, a phenomenon of wrong taking or cross contamination is avoided, and therefore, the subsequent detection precision and detection efficiency is improved.

Preferably, as shown in FIG. 1 to FIG. 5, the fixed receiving plate 320 and the movable receiving plate 340 are matched magnetically.

Further preferably, two ends of the fixed receiving plate 320 each are connected with magnetic blocks 350, and two ends of the movable receiving plate 340 each are connected with ejector rods 330, wherein one end of each of the ejector rods 330 penetrates through the fixed receiving plate 320 and the magnetic blocks 350 and is connected to the movable receiving plate 340, and the other end of the ejector rod 330 is provided with a protrusion portion 331.

Preferably, the stopping arm 500 is arranged in a U-shaped, and a stopping rod 510 is respectively provided on two sides of the opened end of the stopping arm 500, wherein the stopping rod 510 and the ejector rod 330 lean against each other to fit.

In the embodiment, the fixed receiving plate 320 and the movable receiving plate 340 are matched magnetically, so that it is convenient to change the relative distance between the fixed receiving plate 320 and the movable receiving plate 340, and therefore, the sample containers in the receiving trough 310 can fall onto the rotating structure below reliably. In addition, the ejector rod 330 and the fixed receiving plate 320 are in clamping fit via a protruding portion 331 on the ejector rod 330, so that the separating distance between the fixed receiving plate 320 and the movable receiving plate 340 is controlled, and therefore, the ejector rod 330 is prevented from sliding out of the fixed receiving plate 320, thereby, the using reliability of the receiving rack 300 is improved.

Further preferably, the ejector rod 330 and the movable receiving plate 340 are in screw fit.

In the embodiment, by means of screw fit, the ejector rod 330 is rotated to adjust the distance when the movable receiving plate 340 is far away from the fixed receiving plate 320, so that it is suitable for discharging sample containers of different sizes, and therefore, it is guaranteed that when the movable receiving plate 340 is far away from the fixed receiving plate 320, the sample containers in the receiving trough 310 can fall onto the rotating structure below reliably.

Further preferably, a side on the fixed receiving plate 320 opposite to the movable receiving plate 340 is provided with a guiding inclined plane 311, or a side on the movable receiving plate 340 opposite to the fixed receiving plate 320 is provided with a guiding inclined plane 311, or opposites of the fixed receiving plate 320 and the movable receiving plate 340 are both provided with guiding inclined planes 311.

In the embodiment, by arranging the guiding inclined planes 311, self-centering of the sample container on the receiving trough 310 is realized, and the sample container is prevented from rolling out of the receiving trough 310 when entering the receiving trough 310, so that the reliability of the receiving trough 310 is improved.

Preferably, as shown in FIG. 1 to FIG. 5, the rotating structure includes a primary rotating shaft 430 mounted on a rotating bracket 420 and connected with the output end of the rotating motor 410, and two auxiliary rotating shafts 440 fitting the primary rotating shaft 430 and being connected to the rotating bracket 420, wherein a "tripod"-shaped structure is formed between the primary rotating shaft 430 and the two auxiliary rotating shafts 440, and wherein the two auxiliary rotating shafts 440 are driven to rotate as the primary rotating shaft 430 rotates, so that the sample container located between the two auxiliary rotating shafts 440 rotates, and therefore, the blank region on the sample container is fully in the exposed state, and it is convenient to print patient information in the blank region by the printing mechanism 600.

Further preferably, the primary rotating shaft 430 is embedded with an annular magnetic ring 450, or the auxiliary rotating shafts 440 are embedded with annular magnetic rings 450, or both the primary rotating shaft 430 and the auxiliary rotating shafts 440 are embedded with annular magnetic rings 450.

In the embodiment, as the primary rotating shaft 430 or the auxiliary rotating shafts 440 are embedded with the annular magnetic rings 450, an idle stroke is avoided when the primary rotating shaft 430 drives the auxiliary rotating shafts 440 to rotate, so that the rotating reliability of the sample containers is improved.

As shown in FIG. 1 to FIG. 5, the receiving rack 300 is connected with a pushing structure 700 and the pushing structure 700 is located between the receiving trough 310 and the stopping arm 500, wherein two auxiliary rotating shafts 440 are separated at a relative distance via the pushing structure 700, thereby, the printed sample containers are discharged automatically.

In the embodiment, by means of the pushing structure 700, the printed sample containers located on the rotating structure are discharged, and the unprinted sample containers on the receiving trough 310 fall onto the rotating structure by leaning the receiving trough 310 against the stopping arm 500 to fit so as to form a continuous action, so that the printing working efficiency of the sample containers is improved.

Further preferably, the pushing structure 700 includes a U-shaped pushing bracket 710, and two sides of the opened end of the U-shaped pushing bracket 710 are each connected with an ejector block 720, an extension rod 441 is respectively provided on two ends of one of the auxiliary rotating shafts 440, and two extension rods 441 respectively form abutting fit with the ejector block 720 on the corresponding side.

Further preferably, each of two sides of the rotating bracket 420 is provided with a first guide slot 421, and two extension rods 441 are respectively clamped into the corresponding first guide slots 421.

In the embodiment, the rotating bracket 420 is provided with the first guide slot 421, so that when the ejector block 720 pushes extension rod 441 of the auxiliary rotating shaft 440, two ends of the auxiliary rotating shaft 440 to move along the first guide slot 421. The moving linearity of the auxiliary rotating shaft 440 is guaranteed, so that the printed sample containers are discharged smoothly.

Further preferably, the rotating bracket 420 is connected with a discharging guide plate 460.

Preferably, as shown in FIG. 1 to FIG. 5, two ends of the ejector block 720 are connected to the U-shaped pushing support 710 via corresponding rotating rods 730, the rotating rod 730 on the U-shaped pushing support 710 away from the side of the receiving trough 310 is in clamping connection with the second guide slot 711 in the U-shaped pushing support 710, the rotating rod on the U-shaped pushing support 710 close to the side of the receiving trough 310 as a fulcrum when the ejector block 720 rotates, wherein the end of the rotating rod 730 in clamping connection with the second guide slot 711 is connected with the fixing bar 750 on the U-shaped pushing bracket 710 via the elastic piece 740, the ejector block 720 is provided with the first working inclined plane 721 and the second working inclined plane 722, a slope gradient of the first working inclined plane 721 extends obliquely upwards from the end away from the receiving trough 310 to the end of the receiving trough 310, the slope gradient of the second working inclined plane 722 extends obliquely upwards from the end close to the receiving trough 310 to the end of the receiving trough 310, and the slope gradient of the first working inclined plane 721 is smaller than that of the second working inclined plane 722.

In the embodiment, when the pushing structure 700 is close to the rotating structure, the first working inclined plane 721 is in rolling fit with the end portion of the auxiliary rotating shaft 440. Along with progressive increase of the slope gradient on the first working inclined plane 721, the auxiliary rotating shaft 440 is pushed to move along the first guide slot 421, and the auxiliary rotating shaft 440 generates a downward pressure to the ejector block 720 to drive the rotating rod 730 in clamping connection to the second guide slot 711 to move along the second guide slot 711, since the rotating rod close to the side of the receiving trough 310 is fixed, the rotating rod 730 away from the side of the receiving trough 310 moves along the second guide slot 711, so that the ejector block 720 deflects. When the auxiliary rotating shaft 440 bestrides the second working inclined plane 722 from the first working inclined plane 721, as the slope gradient of the second working inclined plane 722 is greater than that of the first working inclined plane 721, rolling connection between the auxiliary rotating shaft 440 and the first working inclined plane 721 is relieved, the auxiliary rotating shaft 440 falls back, and at the time, the completed sample containers are discharged.

The specific embodiments described herein are merely illustrations of spirit of the present invention. Various modifications or supplements can be made on the described specific embodiments or can be replaced a similar manner by those skilled in the art without deviating from the spirit of the present invention or surpassing the scope defined by the attached Claims.

What is claimed is:

1. A printing mechanism for a sample container, characterized by comprising:

a receiving end provided with a receiving rack, the receiving rack being connected with a fixed receiving plate and a movable receiving plate, wherein corresponding receiving trough and falling channel are formed by splicing and separating the fixed receiving plate and the movable receiving plate; and a discharging end provided with a rotating assembly that receives a sample container falling in the falling channel and drives the sample container to rotate to align an unprinted blank region on the sample container with a printing assembly, wherein a position away from the receiving end is provided with a translation motor, an output end of the translation motor is connected with a lead screw, the receiving rack is spirally connected to the lead screw, a stopping arm is arranged on a moving trajectory of the receiving rack, and the fixed receiving plate and the movable receiving plate are separated and actuated as the stopping arm and an ejector rod lean against each other or are separated from each other.

2. The printing mechanism for a sample container according to claim 1, characterized in that the fixed receiving plate and the movable receiving plate are matched magnetically.

3. The printing mechanism for a sample container according to claim 2, characterized in that the fixed receiving plate is connected with a magnetic block and the movable receiving plate is connected with the ejector rod, wherein the ejector rod penetrates through the fixed receiving plate and the magnetic block and is spirally connected to the movable receiving plate, and the fixed receiving plate and the movable receiving plate are separated by pushing the ejector rod.

4. The printing mechanism for a sample container according to claim 3, characterized in that the receiving rack is connected with a pushing structure and the pushing structure is located between the receiving trough and the stopping arm, wherein the two auxiliary rotating shafts are separated at a relative distance via the pushing structure.

5. The printing mechanism for a sample container according to claim 4, characterized in that the pushing structure comprises a pushing bracket and the pushing bracket is connected with ejector blocks in leaning fit with two ends of one of the auxiliary rotating shafts correspondingly, wherein each of the ejector blocks is provided with a first working inclined plane that pushes the auxiliary rotating shaft away and a second working inclined plane that restores the auxiliary rotating shaft, the first working inclined plane and the second working inclined plane being adjacent two inclined planes on the ejector blocks.

6. The printing mechanism for a sample container according to claim 5, characterized in that the first working inclined plane extends obliquely upwards from the end away from the receiving trough to the end close to the receiving trough and the second working inclined plane extends obliquely upwards from the end close to the receiving trough to the end away from the receiving trough, wherein a slope gradient of the first working inclined plane is smaller than that of the second working inclined plane.

7. The printing mechanism for a sample container according to claim 5, characterized in that two ends of the ejector block are respectively connected to the pushing bracket via rotating bars, wherein a connecting rod on the ejector block away from one end of the receiving trough is connected with an elastic piece, and the elastic piece is vertically connected to the pushing bracket via a fixing bar.

8. The printing mechanism for a sample container according to claim 1, characterized in that the rotating assembly comprises a rotating bracket and the rotating bracket is connected with a rotating motor, wherein an output end of the rotating motor is connected with a primary rotating shaft and two auxiliary rotating shafts fitting the primary rotating shaft and being connected to the rotating bracket, and a "tripod"-shaped structure is formed between the primary rotating shaft and the two auxiliary rotating shafts.

9. The printing mechanism for a sample container according to claim 8, characterized in that each of two sides of the rotating bracket is provided with a first guide slot, and two ends of one of the auxiliary rotating shafts are respectively clamped into the first guide slots.

10. The printing mechanism for a sample container according to claim 8, characterized in that the rotating bracket is connected with a discharging guide plate.

11. The printing mechanism for a sample container according to claim 8, characterized in that the primary rotating shaft is embedded with an annular magnetic ring, or the auxiliary rotating shafts are embedded with annular magnetic rings, or both the primary rotating shaft and the auxiliary rotating shafts are embedded with annular magnetic rings.

12. The printing mechanism for a sample container according to claim 1, characterized in that a side on the fixed receiving plate opposite to the movable receiving plate is provided with a guiding inclined plane, or a side on the movable receiving plate opposite to the fixed receiving plate is provided with a guiding inclined plane, or opposites of the fixed receiving plate and the movable receiving plate are both provided with guiding inclined planes.

* * * * *